US006969015B1

(12) United States Patent
Salmela

(10) Patent No.: US 6,969,015 B1
(45) Date of Patent: Nov. 29, 2005

(54) PARTICULATE SAUCE DISPENSING NOZZLE

(75) Inventor: Juha Salmela, Citrus Heights, CA (US)

(73) Assignee: Automatic Bar Controls Inc., Vacaville, CA (US)

( * ) Notice: Subject to any disclaimer, the term of this patent is extended or adjusted under 35 U.S.C. 154(b) by 0 days.

(21) Appl. No.: 10/464,034

(22) Filed: Jun. 17, 2003

(51) Int. Cl.[7] ..... B05B 1/00

(52) U.S. Cl. ..... 239/597; 239/455; 239/589; 239/595; 239/601; 222/282; 222/310; 222/336

(58) Field of Search ..... 239/597–601, 239/37, 38, 501, 507, 568, 589, 595; 222/282, 222/310, 335, 336, 380; 118/24, 308, 320

(56) References Cited

U.S. PATENT DOCUMENTS

| | | | | | |
|---|---|---|---|---|---|
| 577,362 | A | * | 2/1897 | Ettlinger | 239/8 |
| 1,133,711 | A | * | 3/1915 | Cornelius | 239/591 |
| 1,239,373 | A | * | 9/1917 | Farmer et al. | 239/8 |
| 2,609,240 | A | * | 9/1952 | Faukner et al. | 436/180 |
| 2,900,851 | A | * | 8/1959 | Rutledge | 76/101.1 |
| 2,944,743 | A | * | 7/1960 | Kachergis | 239/8 |
| 3,881,654 | A | * | 5/1975 | Larkin | 239/127 |
| 4,236,672 | A | * | 12/1980 | Koeberle | 239/139 |
| 4,633,623 | A | * | 1/1987 | Spitz | 451/102 |
| 4,688,720 | A | * | 8/1987 | MacDonald et al. | 239/17 |
| 5,050,805 | A | * | 9/1991 | Lloyd et al. | 239/424 |
| 5,283,990 | A | * | 2/1994 | Shank, Jr. | 451/90 |
| H1379 | H | * | 12/1994 | Meuer | 451/38 |
| 5,494,828 | A | * | 2/1996 | Leopando | 436/180 |
| 6,357,669 | B1 | * | 3/2002 | Goenka et al. | 239/8 |

* cited by examiner

*Primary Examiner*—Thomas Denion
*Assistant Examiner*—Kyle M. Riddle
(74) *Attorney, Agent, or Firm*—Townsend and Townsend and Crew LLP

(57) ABSTRACT

Embodiments of the present invention are directed to a dispensing nozzle for dispensing a sauce containing particulates which is configured to reduce clogging of the nozzle by the particulates. In one embodiment, a dispensing nozzle comprises a nozzle body having a nozzle cavity with a nozzle inlet and a nozzle outlet. The nozzle inlet has a bore-shape cross section. The nozzle outlet is longitudinal in shape with a length substantially larger than a width. The nozzle cavity extends from the nozzle inlet to the nozzle outlet in a flow direction and has a cross-sectional area which is substantially constant extending from the nozzle inlet along the flow direction to the nozzle outlet.

33 Claims, 4 Drawing Sheets

PARTICULATE SAUCE DISPENSING NOZZLE

CROSS-REFERENCES TO RELATED APPLICATIONS

Not Applicable

BACKGROUND OF THE INVENTION

The present invention relates generally to dispensing apparatus and, more particularly, to a dispensing nozzle for dispensing a sauce containing particulates.

Conventional ways of saucing pizza require manual application of a sauce such as a spicy tomato sauce on the pizza dough. Manual application of the pizza sauce is often performed by a novice, hurried chef who distorts the house recipe and produces an uneven coating. Attempts to provide an accurate dose and an even coating require too much time. In addition, using ladles, spatulas, brushes, and the like in handling the pizza sauce may raise sanitary concerns.

Ladles with brushes or spatulas require a vat of pre-mixed sauce from which is ladled an inconsistent portion. The sauce is brought, dripping to the dough surface, leaving an unsanitary trail of sauce on the table and the sides of the vat. The chef must carefully, expertly spread the sauce across the surface of the dough without leaving puddles or voids or damaged dough. This approach is the least costly, but is also the least consistent and is rather unsanitary.

Spoodles incorporate a hose or nozzle for pumping the sauce into an attached measuring or spreading ladle. The bottom of the ladle is used to spread the sauce. The spoodle is returned, dripping, to the holding device, thereby leaving an unsanitary trail of sauce on the table and the inside of the holding device. This approach is more costly and more consistent, but is still unsanitary.

Pouring nozzles are much more consistent in portion control for dispensing the sauce. When used with a dispensing apparatus, the dispensing nozzle provides a sanitary way of saucing a pizza or the like. If the sauce contains particulates, however, clogging of the nozzle by the particulates can be problematic.

BRIEF SUMMARY OF THE INVENTION

Embodiments of the present invention are directed to a dispensing nozzle for dispensing a sauce containing particulates which is configured to reduce clogging of the nozzle by the particulates. The nozzle outlet of the dispensing nozzle has a longitudinal shape to dispense the sauce in a sheet-like pattern. The nozzle inlet typically has a bore-shaped cross section. In some embodiments, the cross-sectional area of the nozzle cavity is substantially constant extending from the nozzle inlet to the nozzle outlet so as to maintain a generally constant flow rate, thereby reducing flow clogging. In specific embodiments, the nozzle outlet is adjustable in size by moving an adjustable nozzle opening member between a minimum opening position and a maximum opening position to clear the particulates from the nozzle cavity if flow clogging in the nozzle cavity is detected.

In accordance with an aspect of the present invention, a dispensing nozzle comprise a nozzle body having a nozzle cavity with a nozzle inlet and a nozzle outlet. The nozzle inlet has a bore-shape cross section. The nozzle outlet is longitudinal in shape with a length substantially larger than a width. The nozzle cavity extends from the nozzle inlet to the nozzle outlet in a flow direction and has a cross-sectional area which is substantially constant extending from the nozzle inlet along the flow direction to the nozzle outlet.

In some embodiments, the nozzle inlet has a circular planar cross section. The length of the nozzle outlet is at least about 17 times the width of the nozzle outlet. The nozzle outlet has a middle section between two end sections along the length of the nozzle outlet, and the nozzle outlet has an arched front which protrudes in the middle section along the flow direction from the two end sections with respect to the planar cross section of the nozzle inlet. The nozzle cavity is symmetrical with respect to a plane of symmetry extending parallel to the length of the nozzle outlet. The nozzle body comprises two body parts which are joined at the plane of symmetry. The nozzle body includes an interior surface surrounding the nozzle cavity, and the interior surface has a substantially smooth geometric transition between the nozzle inlet and the nozzle outlet.

In accordance with another aspect of the present invention, a dispensing nozzle comprises a nozzle body having a nozzle cavity with a nozzle inlet and a nozzle outlet. The nozzle outlet is longitudinal in shape with a length substantially larger than a width. The nozzle cavity extends from the nozzle inlet to the nozzle outlet in a flow direction. An adjustable nozzle opening member is disposed near the nozzle outlet and is movable between a minimum opening position and a maximum opening position in a direction along the width of the nozzle outlet. The adjustable nozzle opening member at least partially blocks the nozzle outlet in the minimum opening position.

In some embodiments, the adjustable nozzle opening member extends across the length of the nozzle outlet. The adjustable nozzle opening member is partially disposed in a slot in the nozzle body and is movable in the slot between the minimum opening position and the maximum opening position. A biasing member resiliently biases the adjustable nozzle opening member toward the minimum opening position. An actuator is coupled with the adjustable nozzle opening member to move the adjustable nozzle opening member from the minimum opening position to the maximum opening position. The nozzle inlet has a circular planar cross section. The nozzle outlet has a middle section between two end sections along the length of the nozzle outlet, and the nozzle outlet has an arched front which protrudes in the middle section along the flow direction from the two end sections with respect to the planar cross section of the nozzle inlet. The adjustable nozzle opening member is curved and extends generally along the arched front of the nozzle outlet.

In specific embodiments, an actuator is coupled with the adjustable nozzle opening member to move the adjustable nozzle opening member between the minimum opening position and the maximum opening position. A sensor is configured to sense flow clogging in the nozzle cavity and generate a flow clogging signal. A controller is coupled with the sensor to receive the flow clogging signal and activate the actuator upon receiving the flow clogging signal to move the adjustable nozzle opening member to the maximum opening position. The sensor may comprise a pressure sensor configured to sense an increase in pressure in the nozzle cavity above a preset level indicating flow clogging. The sensor may comprise an optical sensor configured to optically sense an uneven flow from the nozzle outlet indicating flow clogging.

DETAILED DESCRIPTION OF THE INVENTION

Figure 1:
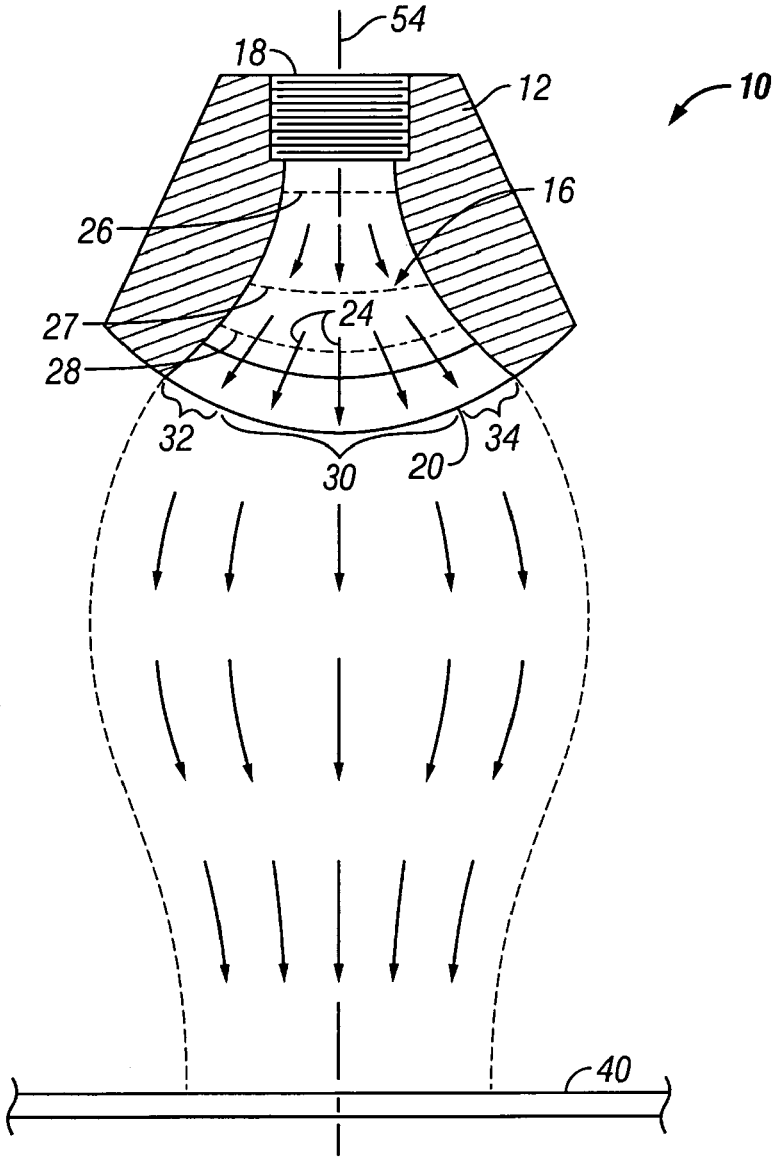
FIG. 1 is a cross-sectional view of the dispensing nozzle according to an embodiment of the present invention.
Figure 2:
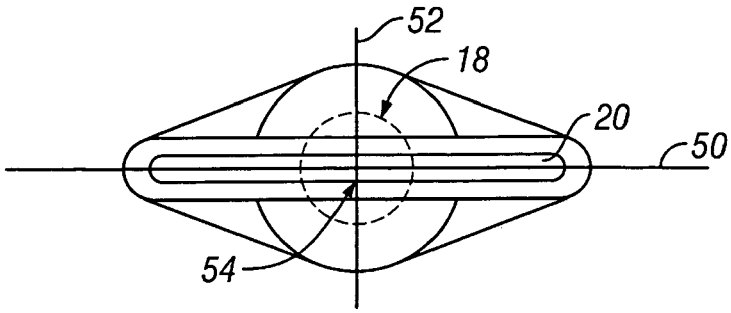
FIG. 2 is a bottom plan view of the dispensing nozzle of FIG. 1.
Figure 3:
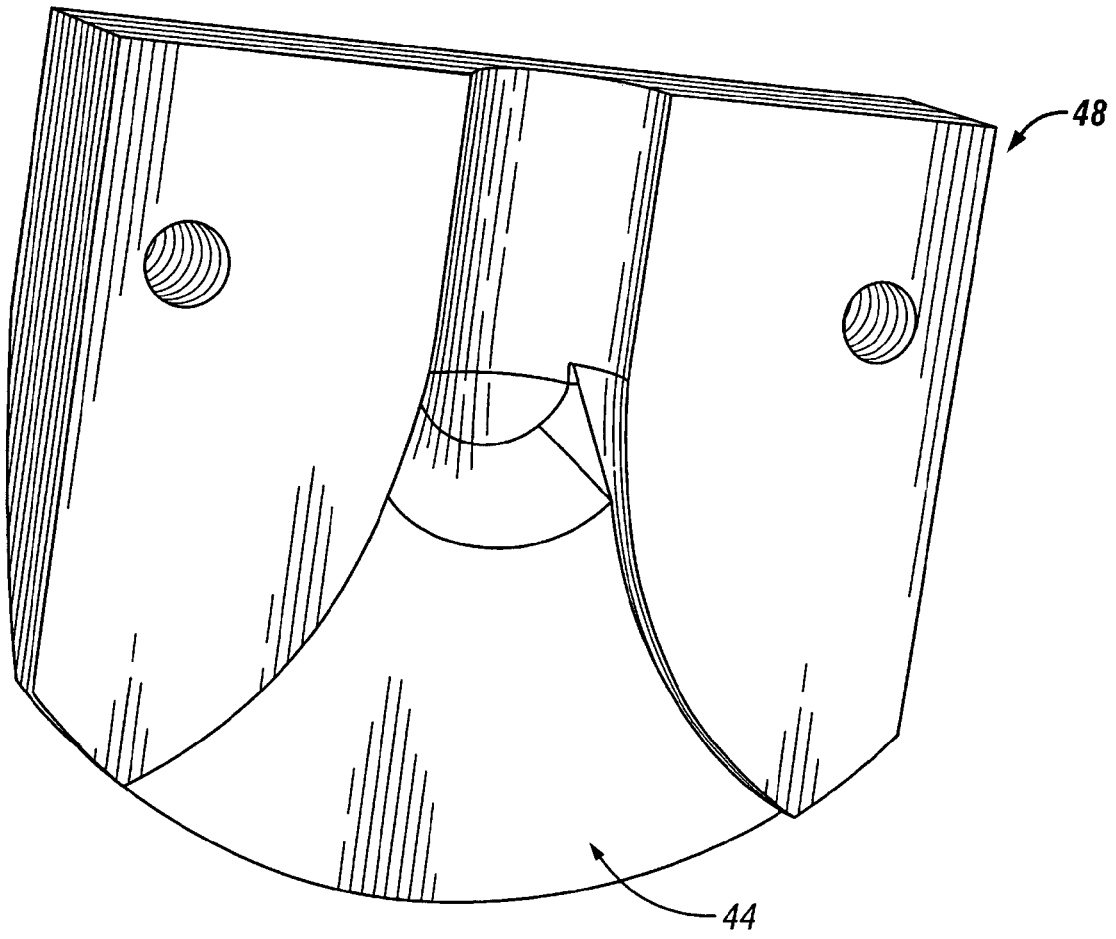
FIG. 3 is a perspective view of half of the dispensing nozzle of FIG. 1 showing the interior surface of the nozzle.

FIGS. 1–3 show a nozzle 10 which includes a nozzle body 12 having a nozzle cavity 16 with a nozzle inlet 18 and a nozzle outlet 20. The nozzle inlet 18 has a bore-shape cross section and may be configured to be connected with an inlet tube for supplying a sauce or the like. The nozzle inlet 18 typically has a circular planar cross section, but the cross section may be polygonal or the like in other embodiments. The dimensions of the bore-shape cross section of the nozzle inlet 18 in two orthogonal directions are typically within about 20 percent of one another. In the case of a circular nozzle inlet 18, the diameter is constant. The nozzle outlet 20, on the other hand, is longitudinal in shape with a length substantially larger than a width, as best seen in FIG. 2. The length of the nozzle outlet 20 typically is at least about 17 times, more desirably at least about 48 times, the width of the nozzle outlet 20. The nozzle cavity 16 extends from the nozzle inlet 18 to the nozzle outlet 20 in a flow direction 24 as indicated by the arrows of FIG. 1. The cross-sectional area of the nozzle cavity 16 is substantially constant extending from the nozzle inlet 18 along the flow direction 24 to the nozzle outlet 20. For instance, the cross-sectional area varies less than about 10 percent between the nozzle inlet 18 and the nozzle outlet 20 at the nozzle inlet 18, the nozzle outlet 20, and intermediate locations 26, 27, 28. In this way, the flow of the sauce from the nozzle inlet 18 to the nozzle outlet 20 maintains a generally constant flow rate to minimize clogging of the particulates in the sauce due to a drop in the flow rate.

As best seen in FIG. 1, the nozzle outlet 20 has a middle section 30 between two end sections 32, 34 along the length of the nozzle outlet 20. The nozzle outlet 20 has an arched front which protrudes in the middle section 30 along the flow direction 24 from the two end sections with respect to the planar cross section of the nozzle inlet 18. FIG. 1 schematically illustrates the flow pattern of the sauce exiting from the nozzle outlet 20 and landing on a receiving surface 40 such as a pizza dough. The longitudinal nozzle outlet 20 produces a sheet-like sauce flow. When used with a rotating receiving surface 40, the sauce is deposited on the receiving surface 40 in a ribbon-like manner. Examples of a pumping system and a dispensing apparatus for use with the dispensing nozzle are found in commonly assigned, copending U.S. patent application Ser. Nos. 10/365,709, 10/364,301, and 10/364,689, which are incorporated herein by reference in their entireties.

FIG. 3 shows a body part 48 as half of the nozzle body 12. The nozzle body 12 has an interior surface 44 surrounding the nozzle cavity 16. The interior surface 44 desirably has a substantially smooth geometric transition between the nozzle inlet 18 and the nozzle outlet 20, as the nozzle cavity 16 changes from a bore-like cross section to a longitudinal cross section. That is, the interior surface 44 desirably does not have any sharp edges or abrupt geometric discontinuities as it changes shape between the nozzle inlet 18 and the nozzle outlet 20. This facilitates a smoother flow of the sauce, especially if the sauce contains particulates.

In the embodiment of FIGS. 1–3, the nozzle cavity 16 is symmetrical with respect to a plane of symmetry 50 extending parallel to the length of the nozzle outlet 20. FIG. 3 shows half of the nozzle body 12 cut through the plane of symmetry 50. The nozzle cavity 16 is also symmetrical with respect to an orthogonal plane 52 through the center line 54 of the nozzle cavity 16. The nozzle body 12 may be formed by joining two half body parts 48 (see FIG. 3) at the plane of symmetry 50 using fasteners, adhesives, or the like. This allows the nozzle body 12 to be more easily formed due to the difficulty in forming the rather complex interior surface 44 of the nozzle body 12 as a whole. The half body part 48 can be formed more easily, for example, by injection molding, casting, or the like.

Figure 5:
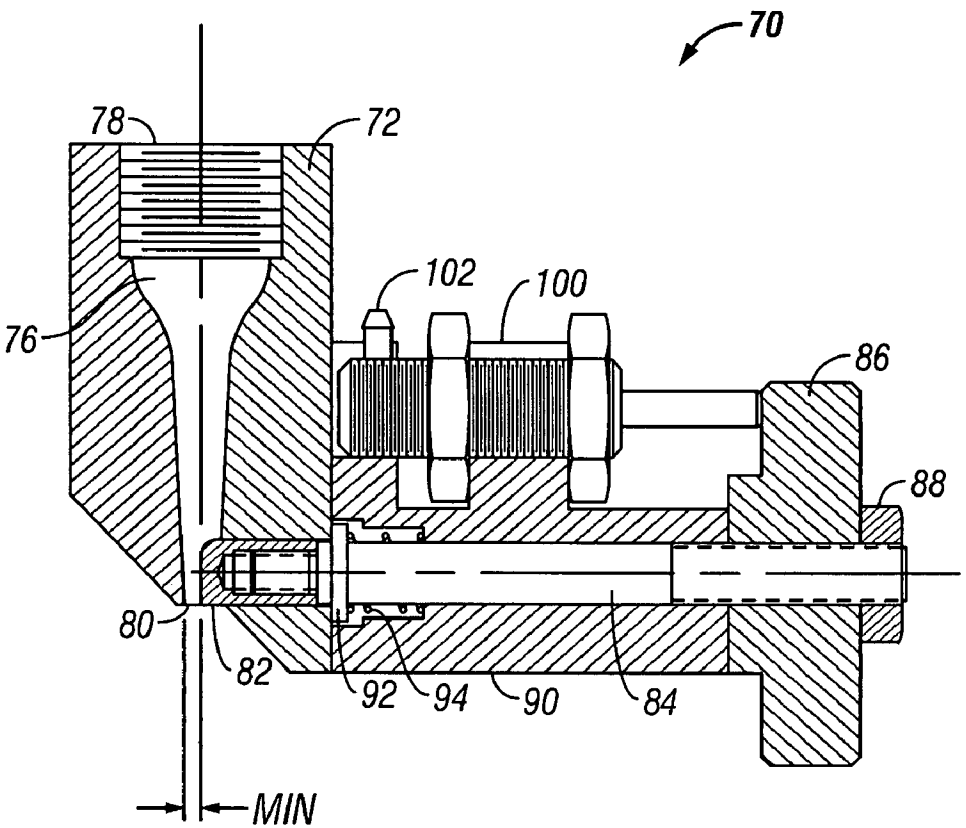
FIG. 5 is a side cross-sectional view of the dispensing nozzle of FIG. 4 in a minimum opening position.
Figure 4:
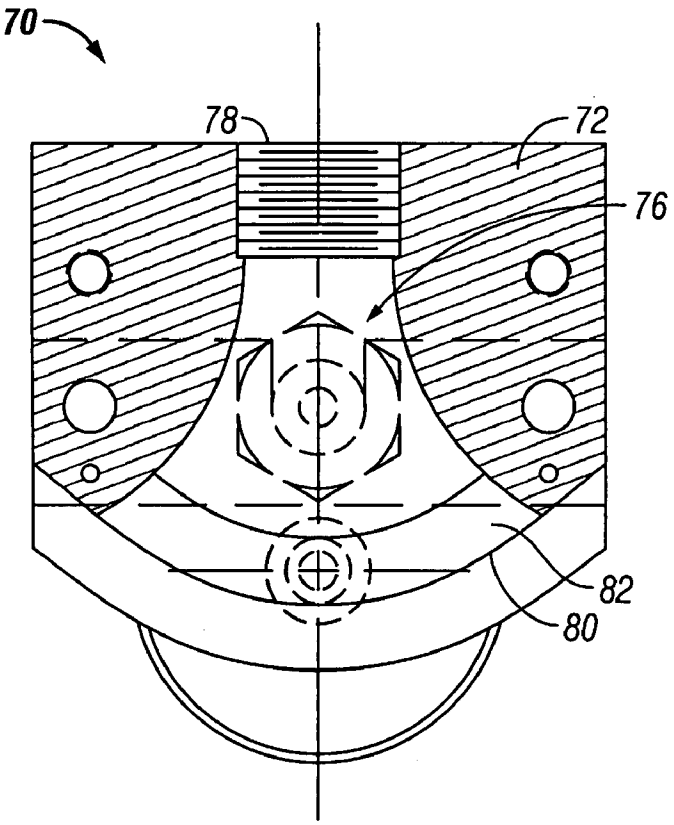
FIG. 4 is a front cross-sectional view of the dispensing nozzle according to another embodiment of the present invention.
Figure 6:
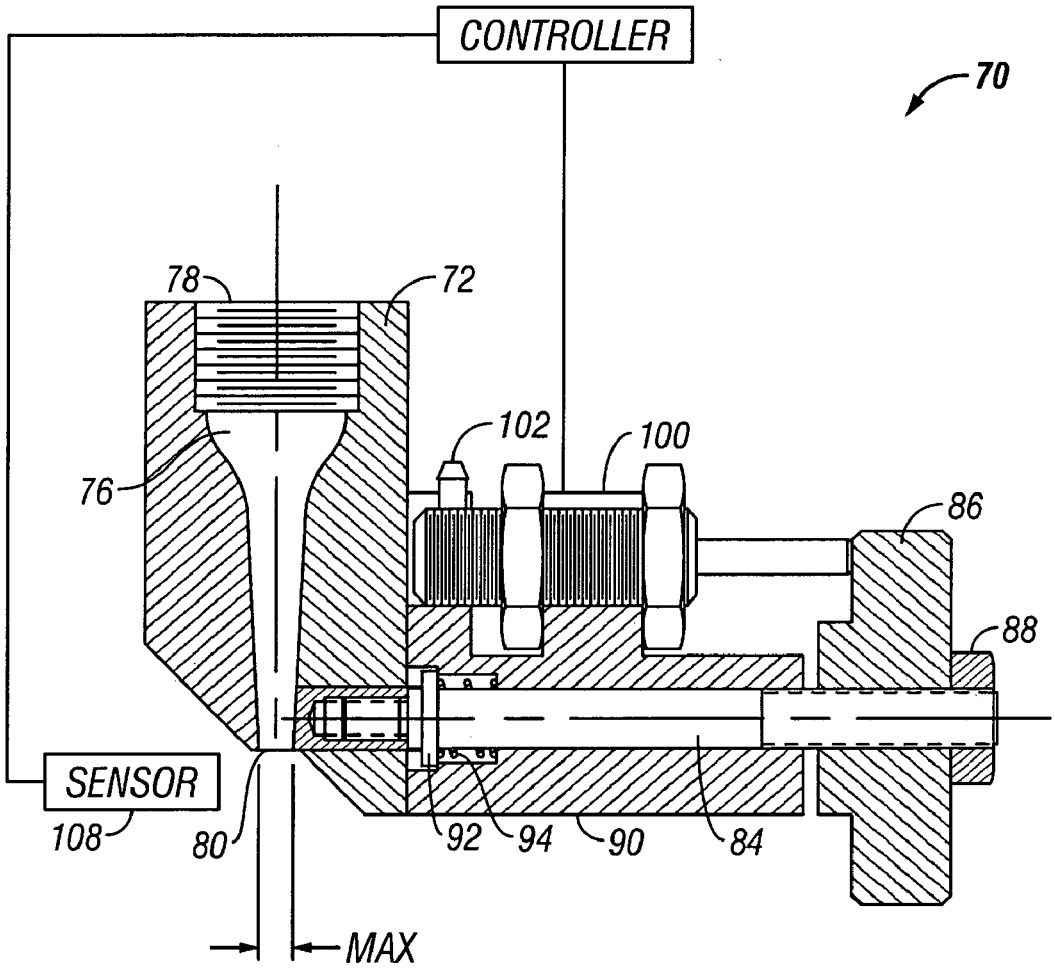
FIG. 6 is a side cross-sectional view of the dispensing nozzle of FIG. 4 in a maximum opening position.

FIGS. 4–6 show another embodiment of a dispensing nozzle 70 which includes a nozzle body 72 having a nozzle cavity 76 with a nozzle inlet 78 and a nozzle outlet 80. The nozzle cavity 76, nozzle inlet 78, and nozzle outlet 80 of the nozzle 70 may be similar in shape to those of the nozzle 10 of FIGS. 1–3. An adjustable nozzle opening member 82 is disposed near the nozzle outlet 80, and is movable between a minimum opening position and a maximum opening position. FIG. 5 shows a minimum opening position at which the adjustable member 82 partially blocks the nozzle outlet 80. At the maximum opening position as seen in FIG. 6, the adjustable member 82 does not block the nozzle outlet 80. In the embodiment shown, the adjustable nozzle opening member 82 is movable in a direction along the width of the nozzle outlet 80 between the minimum opening position and the maximum opening position. The adjustable member 82 extends across the length of the nozzle outlet 80. For the nozzle outlet 80 having the arched front as shown in FIG. 4, the adjustable member 82 is curved to match the shape of the arched front of the nozzle outlet 80.

As seen in FIGS. 5 and 6, the adjustable nozzle opening member 82 is partially disposed in a slot in the nozzle body 72 and is movable in the slot between the minimum opening position and the maximum opening position. The adjustable member 82 is coupled to a shaft 84 that is connected to a knob 86 by a lock nut 88. The shaft 84 is movable in a cavity of a housing 90 which is attached to the nozzle body 72. The shaft 84 includes a shoulder 92 coupled to a biasing member such as a spring 94 which biases the adjustable nozzle opening member 82 toward the minimum opening position. The knob 86 may be pulled manually or automatically by a mechanism to move the adjustable member 82 from the minimum opening position to the maximum opening position. FIGS. 5 and 6 show an actuator 100 which bears against the knob 86 to move the adjustable member 82. The actuator 100 is mounted on the housing 90, and may be an air cylinder with an air inlet 102. In alternative embodiments, the actuator 100 may be a solenoid or the like.

The adjustable nozzle opening member 82 is moved to the maximum opening position for a brief period and back the minimum opening position (e.g., about 0.15–0.2 second) to allow clogged particulates to pass through the nozzle outlet 80 and clear the nozzle cavity 76. The operator can visually observe the flow from the nozzle 70 to determine when the nozzle cavity 76 is clogged. Instead of a generally uniform sheet, the flow will be discontinuous, split, or otherwise uneven when the nozzle cavity 76 is clogged. The operator may manually pull the knob 86 or activate the actuator 100 to move the adjustable nozzle opening member 82. Alternatively, a sensor 108 may be provided to detect clogging and a controller 110 is configured to automatically activate the actuator 100 to move the adjustable member 82 upon receiving a clogging signal from the sensor 108. The sensor 108 may be an optical sensor for optically sensing the uneven flow as a result of clogging, or a pressure transducer or sensor for detecting the pressure buildup in the nozzle cavity 76 due to clogging, or the like. For convenience, the sensor 108 and the controller 110 are shown only in FIG. 6.

The above-described arrangements of apparatus and methods are merely illustrative of applications of the principles of this invention and many other embodiments and modifications may be made without departing from the spirit and scope of the invention as defined in the claims. The scope of the invention should, therefore, be determined not with reference to the above description, but instead should be determined with reference to the appended claims along with their full scope of equivalents.

What is claimed is:

1. A dispensing nozzle comprising:

a nozzle body having a nozzle cavity with a nozzle inlet and a nozzle outlet, the nozzle inlet having a bore-shape cross section, the nozzle outlet being longitudinal in shape with a length substantially larger than a width, the nozzle cavity extending from the nozzle inlet to the nozzle outlet in a flow direction and having a cross-sectional area which is substantially constant extending from the nozzle inlet along the flow direction to the nozzle outlet;

an adjustable nozzle opening member disposed near the nozzle outlet and being movable between a minimum opening position and a maximum opening position, the adjustable nozzle opening member at least partially blocking the nozzle outlet in the minimum opening position; and a biasing member resiliently biasing the adjustable nozzle opening member toward the minimum opening position.

2. The dispensing nozzle of claim 1 wherein the nozzle inlet has a circular planar cross section.

3. The dispensing nozzle of claim 1 wherein the nozzle inlet has a planar cross section, wherein the nozzle outlet has a middle section between two end sections along the length of the nozzle outlet, and wherein the nozzle outlet has an arched front which protrudes in the middle section along the flow direction from the two end sections with respect to the planar cross section of the nozzle inlet.

4. The dispensing nozzle of claim 1 wherein the nozzle cavity is symmetrical with respect to a plane of symmetry extending parallel to the length of the nozzle outlet.

5. The dispensing nozzle of claim 4 wherein the nozzle body comprises two body parts which are joined at the plane of symmetry.

6. The dispensing nozzle of claim 1 wherein the nozzle body includes an interior surface surrounding the nozzle cavity, and wherein the interior surface has a substantially smooth geometric transition between the nozzle inlet and the nozzle outlet.

7. The dispensing nozzle of claim 1 wherein the length of the nozzle outlet is at least about 17 times the width of the nozzle outlet.

8. The dispensing nozzle of claim 1 wherein the adjustable nozzle opening member is movable in a direction along the width of the nozzle outlet between the minimum opening position and the maximum opening position.

9. The dispensing nozzle of claim 1 further comprising:

an actuator coupled with the adjustable nozzle opening member to move the adjustable nozzle opening member between the minimum opening position and the maximum opening position;

a sensor configured to sense flow clogging in the nozzle cavity and generate a flow clogging signal; and a controller coupled with the sensor to receive the flow clogging signal and activate the actuator upon receiving the flow clogging signal to move the adjustable nozzle opening member to the maximum opening position.

10. The dispensing nozzle of claim 1 further comprising an actuator coupled with the adjustable nozzle opening member to move the adjustable nozzle opening member between the minimum opening position and the maximum opening position.

11. A dispensing nozzle comprising:

a nozzle body having a nozzle cavity with a nozzle inlet and a nozzle outlet, the nozzle outlet being longitudinal in shape with a length substantially larger than a width, the nozzle cavity extending from the nozzle inlet to the nozzle outlet in a flow direction;

an adjustable nozzle opening member disposed near the nozzle outlet and being movable between a minimum opening position and a maximum opening position in a direction along the width of the nozzle outlet, the adjustable nozzle opening member at least partially blocking the nozzle outlet in the minimum opening position; and a biasing member resiliently biasing the adjustable nozzle opening member toward the minimum opening position; and an actuator coupled with the adjustable nozzle opening member to move the adjustable nozzle opening member from the minimum opening position to the maximum opening position.

12. The dispensing nozzle of claim 11 wherein the adjustable nozzle opening member extends across the length of the nozzle outlet.

13. The dispensing nozzle of claim 11 wherein the adjustable nozzle opening member is partially disposed in a slot in the nozzle body and is movable in the slot between the minimum opening position and the maximum opening position.

14. The dispensing nozzle of claim 11 wherein the length of the nozzle outlet is at least about 17 times the width of the nozzle outlet.

15. The dispensing nozzle of claim 11 wherein the nozzle inlet has a bore-shape cross section, and wherein the nozzle cavity has a cross-sectional area which is substantially constant extending from the nozzle inlet along the flow direction to the nozzle outlet.

16. The dispensing nozzle of claim 15 wherein the nozzle inlet has a circular planar cross section, wherein the nozzle outlet has a middle section between two end sections along the length of the nozzle outlet, and wherein the nozzle outlet has an arched front which protrudes in the middle section along the flow direction from the two end sections with respect to the planar cross section of the nozzle inlet.

17. The dispensing nozzle of claim 16 wherein the adjustable nozzle opening member is curved and extends generally along the arched front of the nozzle outlet.

18. The dispensing nozzle of claim 15 wherein the nozzle cavity is symmetrical with respect to a plane of symmetry extending parallel to the length of the nozzle outlet, and wherein the nozzle body comprises two body parts which are joined at the plane of symmetry.

19. The dispensing nozzle of claim 15 wherein the nozzle body includes an interior surface surrounding the nozzle cavity, and wherein the interior surface has a substantially smooth geometric transition between the nozzle inlet and the nozzle outlet.

20. The dispensing nozzle of claim 11 further comprising:

an actuator coupled with the adjustable nozzle opening member to move the adjustable nozzle opening member between the minimum opening position and the maximum opening position;

a sensor configured to sense flow clogging in the nozzle cavity and generate a flow clogging signal; and a controller coupled with the sensor to receive the flow clogging signal and activate the actuator upon receiving the flow clogging signal to move the adjustable nozzle opening member to the maximum opening position.

21. The dispensing nozzle of claim 20 wherein the sensor comprises a pressure sensor configured to sense an increase in pressure in the nozzle cavity above a preset level indicating flow clogging.

22. The dispensing nozzle of claim 20 wherein the sensor comprises an optical sensor configured to optically sense an uneven flow from the nozzle outlet indicating flow clogging.

23. A dispensing nozzle comprising:

a nozzle body having a nozzle cavity with a nozzle inlet and a nozzle outlet, the nozzle inlet having a bore-shape cross section, the nozzle outlet being longitudinal in shape with a length substantially larger than a width, the nozzle cavity extending from the nozzle inlet to the nozzle outlet in a flow direction and having a cross-sectional area which is substantially constant extending from the nozzle inlet along the flow direction to the nozzle outlet;

an adjustable nozzle opening member disposed near the nozzle outlet and being movable between a minimum opening position and a maximum opening position, the adjustable nozzle opening member at least partially blocking the nozzle outlet in the minimum opening position; and an actuator coupled with the adjustable nozzle opening member to move the adjustable nozzle opening member between the minimum opening position and the maximum opening position.

24. The dispensing nozzle of claim 23 wherein the adjustable nozzle opening member is movable in a direction along the width of the nozzle outlet between the minimum opening position and the maximum opening position.

25. The dispensing nozzle of claim 23 further comprising a biasing member resiliently biasing the adjustable nozzle opening member toward the minimum opening position.

26. The dispensing nozzle of claim 23 wherein the nozzle inlet has a circular planar cross section.

27. The dispensing nozzle of claim 23 wherein the nozzle inlet has a planar cross section, wherein the nozzle outlet has a middle section between two end sections along the length of the nozzle outlet, and wherein the nozzle outlet has an arched front which protrudes in the middle section along the flow direction from the two end sections with respect to the planar cross section of the nozzle inlet.

28. The dispensing nozzle of claim 23 wherein the nozzle cavity is symmetrical with respect to a plane of symmetry extending parallel to the length of the nozzle outlet.

29. The dispensing nozzle of claim 28 wherein the nozzle body comprises two body parts which are joined at the plane of symmetry.

30. The dispensing nozzle of claim 23 wherein the nozzle body includes an interior surface surrounding the nozzle cavity, and wherein the interior surface has a substantially smooth geometric transition between the nozzle inlet and the nozzle outlet.

31. A dispensing nozzle comprising:

a nozzle body having a nozzle cavity with a nozzle inlet and a nozzle outlet, the nozzle outlet being longitudinal in shape with a length substantially larger than a width, the nozzle cavity extending from the nozzle inlet to the nozzle outlet in a flow direction;

an adjustable nozzle opening member disposed near the nozzle outlet and being movable between a minimum opening position and a maximum opening position in a direction along the width of the nozzle outlet, the adjustable nozzle opening member at least partially blocking the nozzle outlet in the minimum opening position;

an actuator coupled with the adjustable nozzle opening member to move the adjustable nozzle opening member between the minimum opening position and the maximum opening position;

a sensor configured to sense flow clogging in the nozzle cavity and generate a flow clogging signal; and a controller coupled with the sensor to receive the flow clogging signal and activate the actuator upon receiving the flow clogging signal to move the adjustable nozzle opening member to the maximum opening position.

32. The dispensing nozzle of claim 31 wherein the sensor comprises a pressure sensor configured to sense an increase in pressure in the nozzle cavity above a preset level indicating flow clogging.

33. The dispensing nozzle of claim 31 wherein the sensor comprises an optical sensor configured to optically sense an uneven flow from the nozzle outlet indicating flow clogging.

* * * * *